US005942847A

United States Patent [19]

Roth

[11] Patent Number: 5,942,847

[45] Date of Patent: Aug. 24, 1999

[54] CATHODE RAY TUBE

[75] Inventor: Arnold Roth, Erbach, Germany

[73] Assignee: AEG Elektronische Röhren GmbH, Ulm, Germany

[21] Appl. No.: 08/899,727

[22] Filed: Jul. 24, 1997

[30] Foreign Application Priority Data

Jul. 26, 1996 [DE] Germany ..... 196 30 200

[51] Int. Cl.[6] ..... H01J 29/48

[52] U.S. Cl. ..... 313/456; 313/444; 313/456; 313/446

[58] Field of Search ..... 313/417, 444, 313/447, 451, 456, 446

[56] References Cited

U.S. PATENT DOCUMENTS 3,032,674 5/1962 Schwartz .
3,250,949 5/1966 Weber et al. ..... 313/456 X

FOREIGN PATENT DOCUMENTS 30 10 807 A1 10/1980 Germany .

*Primary Examiner*—Ashok Patel
*Attorney, Agent, or Firm*—McGlew and Tuttle, P.C.

[57] ABSTRACT

A grid arrangement with a plurality of control grids with a layered design with ceramic spacers for a cathode ray tube. The grid arrangement can be manufactured in a simple manner and reliably with high precision even in the case of very small dimensions. Very low grid capacity can be reached by structuring the conductor layers.

20 Claims, 6 Drawing Sheets

CATHODE RAY TUBE

FIELD OF THE INVENTION

The present invention pertains to a cathode ray tube with a grid arrangement comprising a plurality of grid electrodes, in which electrodes following each other in the direction of the beam are separated by insulating spacers with inner openings and the electrodes and spacers are mechanically connected.

BACKGROUND OF THE INVENTION

A cathode ray tube, in which a ceramic ring acting as the support body has a flat surface and, opposite it, a truncated cone-shaped depression, has been known from DE 30 10 807 A1. A first, flat grid electrode is fastened on the flat side, and a second grid electrode on the opposite side of the support body, wherein the second grid electrode extends with a truncated cone-shaped section into the depression. The support body has a central opening, in which the two grid electrodes are located opposite each other with coaxially directed beam openings.

U.S. Pat. No. 3,032,674 describes a grid arrangement for a cathode ray tube, in which metallic disk electrodes are insulated from one another by ceramic insulating disks. The central aperture openings of the disk electrodes are spanned over by fine-mesh electrode grids. The layered grid structure is held together by screws.

SUMMARY AND OBJECTS OF THE INVENTION

The primary object of the present invention is to provide a cathode ray tube, whose grid arrangement can be manufactured at low expense and with high precision and leads to improved imaging properties.

According to the invention, a cathode ray tube with a grid arrangement is provided with a plurality of grid electrodes, in which electrodes following each other in the direction of the beam are separated by insulating spacers with inner openings. The electrodes and spacers are mechanically connected. The electrodes have a central part with a central beam opening and a terminal part. The central parts of the electrodes overlap in the direction of the beam, but the terminal parts do not.

The spacers and electrodes are preferably designed as flat spacers and electrodes. Additional segments of a thickness at least approximately equal to that of the terminal parts of the electrodes may be inserted in the areas not occupied by terminal parts of the electrodes between adjacent spacers. These additional segments may be electrically insulated metallic segments. The additional segments may consist of an insulating material, especially ceramic.

The grid electrodes and optionally inserted additional segments may be soldered to the spacers. The diameters of the inner openings of the spacers may be large compared with the diameters of the beam openings in the grid electrodes. The central part has approximately the dimension of the inner openings of the spacers located adjacent to the grid electrode. The central part may also be smaller than the inner openings of the spacers and may have at least one holding strap extending between the adjacent spacers. The central part extends over its entire circumference between the spacers.

The parts used in the grid arrangement of the cathode ray tubes according to the present invention can be manufactured at low cost with high precision and can be assembled to the connected arrangement. The connected grid arrangement is compact, mechanically stable and can be handled in a simple manner, and it can be assembled and tested outside the tube. The spacers guarantee the highly accurate maintenance of preset, mutual grid electrode distances without separate adjustment measures. An especially low-capacity grid arrangement is achieved for cathode ray tubes with very high control signal frequency due to a design and arrangement of the grid electrodes and possibly of other conductive layers and elements in which overlaps are avoided, so that a high image resolution of a monitor tube is possible especially at equal image frequency.

The present invention will be illustrated below in detail on the basis of examples with reference to the figures.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
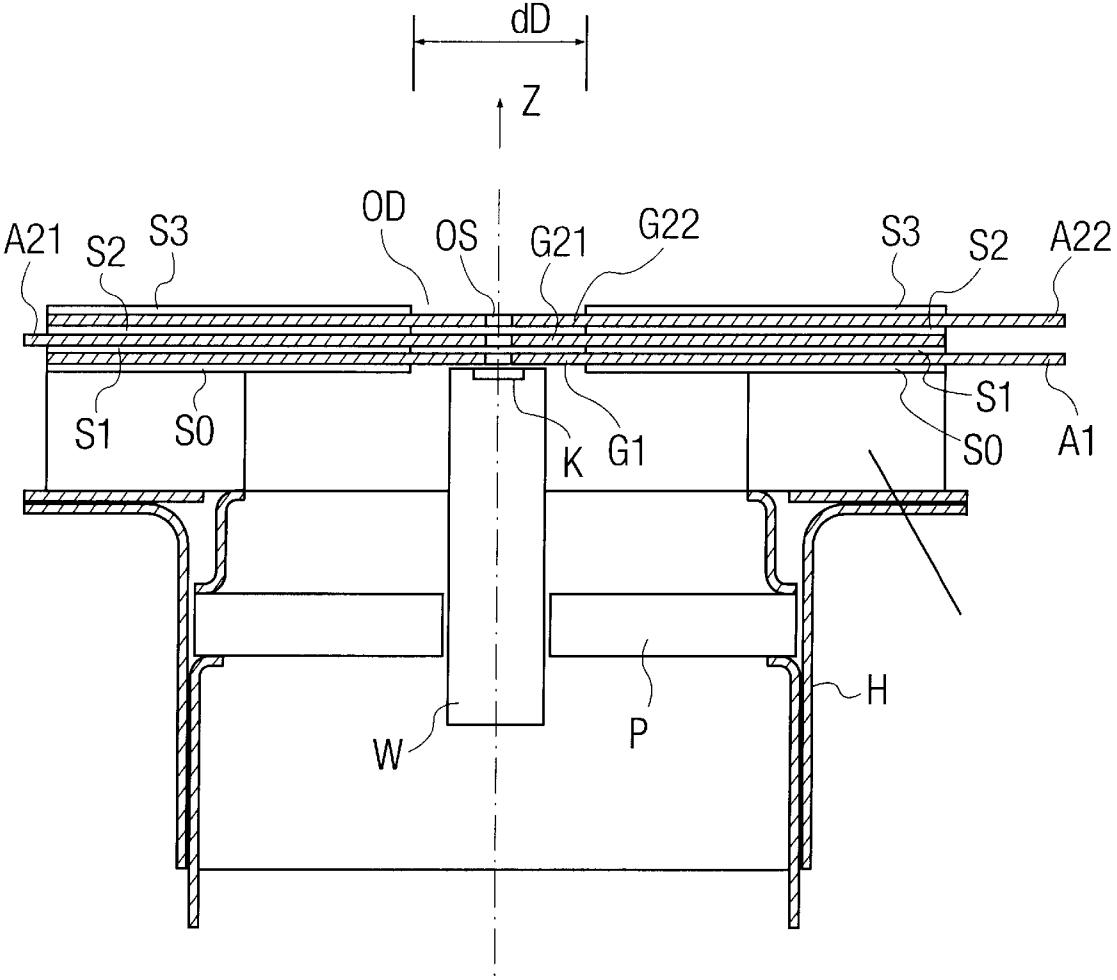
FIG. 1 is a cross sectional view through a grid arrangement of a cathode ray tube according to the present invention.

The grid arrangement shown schematically in FIG. 1 shows a preferred case of application of the present invention in a cathode ray tube with a first grid with a grid electrode G1 and with a second grid with two separate grid electrodes G21 and G22 following each other in the direction of the beam. The grids are used to focus and control the intensity of a flow of electrons emitted by a cathode K. The design and the fastening of the cathode via a cathode sleeve W and a support P in brackets H have been known in various forms and are not themselves the subject of the present invention.

The grid electrodes are designed as flat plates or metal foils with a thickness of typically 0.05 mm to 0.5 mm. The central grid electrode G21 is separated from the grid electrode G22 by a spacer S2 and from the grid electrode G1 by a spacer S1 and is electrically insulated from same. The spacers are designed as ring disks with a circular inner opening OD. The spacers preferably consist of a ceramic, especially $Al_2O_3$ ceramic, and are rigidly connected to the grid electrodes. Soldering is preferably employed as the connection technique. The series of layers of alternating metallic electrode and ceramic spacer is advantageously sealed in both directions by additional ceramic members in the form of ring disks S0 and S3, which are likewise soldered to the grid electrodes G1 and G22, respectively.

The spacers S1, S2 and the additional ceramic members S0 and S3 preferably, but not necessarily, have the same diameters dD as the circular inner openings. The grid electrodes have a central beam opening OS. The diameters of the beam openings are usually not uniform for all grid electrodes and are small, equaling 0.1 to 0.7 mm, compared with the diameters dD of the spacers, which are typically in the range of 1 mm to 5 mm. Terminal lugs A1 and A21 and A22 pointing to the outside are provided at the grid electrodes.

The grid electrodes advantageously consist of a material that has a similar coefficient of thermal expansion as the material of the spacers. The spacers consist, e.g., of $Al_2O_3$ ceramic and the grid electrodes of molybdenum, titanium or an alloy called FeNi42. Quartz with a lower dielectric constant compared with that of the $Al_2O_3$ ceramic is advantageous as a material for the spacers and the additional ring members S0, S3 to reduce the grid capacity.

The thicknesses of the spacers S1, S2 determine essentially the mutual distance between the grid electrodes. The thicknesses of the spacers are typically in the range of 0.05 mm to 1.0 mm. The different spacers S1, S2 usually have different thicknesses. The thickness of solder layers between the spacer and the grid electrodes may also have to be taken into account for the mutual distance between the grid electrodes, and it may have to be taken into account in dimensioning. In the case of the preferred use of solder in the form of soldering foil to be placed between the spacers and the grid electrodes, the thickness of the solder layers may be assumed to be typically 5 $\mu$m to 40 $\mu$m. As an alternative to the use of soldering foils, the surfaces of grid electrodes and spacers (as well as the additional ring members S0, S3) may also be provided with coatings suitable for soldering. Other techniques, in which the materials of the grid electrodes (and ring members) and of the spacers are coordinated with one another such that a rigid connection can be prepared without intermediate material, are also advantageous and suitable. For example, copper may diffuse from copper-containing molybdenum plates to the plate surface at high temperatures and bring about a connection with the ceramic of the spacers there.

To prepare the connected grid arrangement from grid electrodes G1, G21, G22, spacers S1, S2 and additional ring members S0, S3, the individual prefabricated elements are stacked up, optionally inserting soldering foils. The grid electrodes are preferably provided with the beam openings in advance, and the different grid electrodes can be adjusted with coaxial alignment of the beam openings by means of a centering gauge, e.g., a mandrel. The elements of the stack are soldered to one another by heating and they form a compact, mechanically stable and easy-to-handle grid arrangement, which is connected to the other components of the beam-generating and focusing system, especially the cathode arrangement. The maintenance of an important distance between the first grid electrode G1 and the cathode can be guaranteed by a separate preassembly and adjustment of a cathode assembly unit with the cathode sleeve W, the support plate P, the brackets H, and the spacer ring R.

A grid arrangement with circular disk-shaped grid electrodes G1, G21, G22 similar to the arrangement known from U.S. Pat. No. 3,032,674 would have a relatively high capacity between the grid electrodes, which has an unfavorable effect on the maximum signal frequency when one or more of these grids is driven with a high-frequency control signal, because of the large opposing surfaces and the short distances between the electrodes. To reduce the grid capacity, the grid electrodes are advantageously structured and arranged such that the smallest possible overlap of the electrode surfaces will be obtained.

Figure 2A:
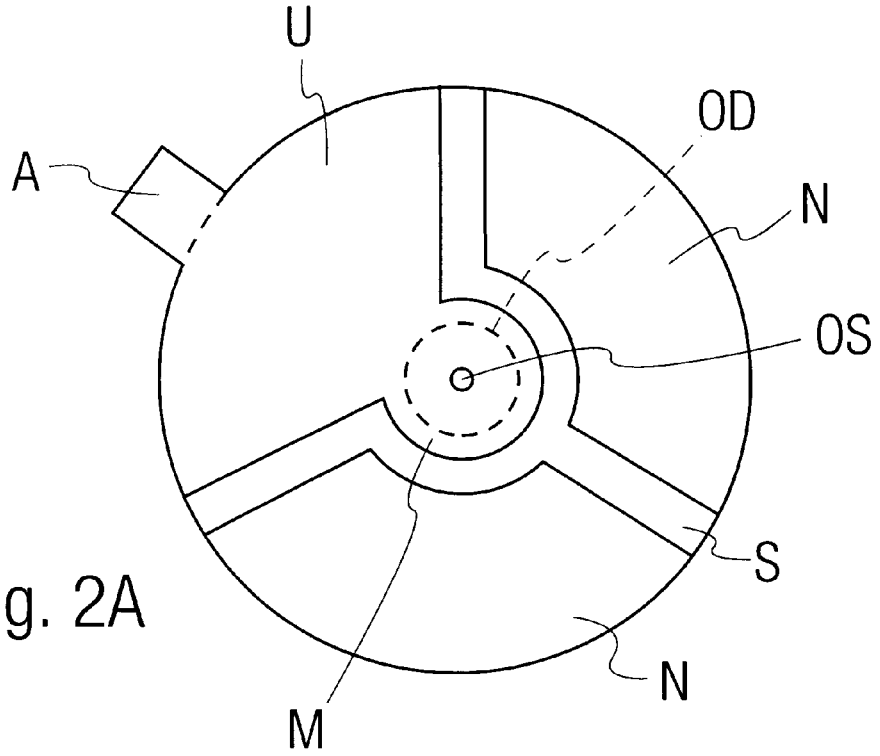
FIG. 2A is a top view of an advantageous embodiment of grid electrodes.
Figure 2B:
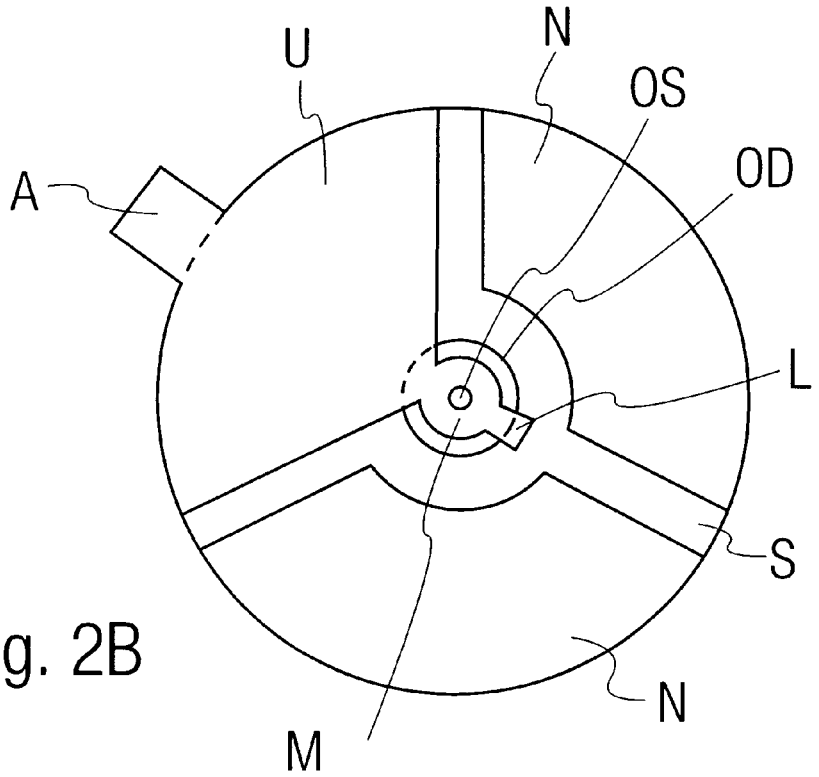
FIG. 2B is a top view of another advantageous embodiment of grid electrodes.

The advantageous examples of the design of grid electrodes shown schematically in FIGS. 2(A) and (B) for a connected arrangement with three grid electrodes G1, G21, G22 as in the example according to FIG. 1 show a central part M around the beam opening OS, which central part M advantageously has an essentially circular contour, and whose diameter is in the range of the diameter of the inner opening OD of the spacer S and deviates from same preferably by less than 30%. The central part is connected to the terminal lug A via a control signal-carrying section U of the grid electrode. The diameter of the central part is larger than that of the inner opening OD in the example according to FIG. 2(A), so that the central part extends over its entire circumference between two adjacent spacers or additional ring members S and is held there. The diameter of the central part is smaller than the inner opening OD in the example shown schematically in FIG. 2(B). The central part is held in this case via the section U and optionally one or more holding straps L extending into the area between the members S. The connection section U occupies less than one third of the circular segment of the area between the members S and it may also be substantially narrower, especially for the function of the signal feed. In the areas of the surface not required for the grid electrode between the members S, additional elements N are arranged, which have the same thickness as the section U of the grid electrode. These additional elements N assume the mechanical function of rigidly connecting the members S to guarantee the parallel alignment of connected members S. To avoid undesired capacitive couplings of different grid electrodes, the grid electrodes, the additional elements N if made of metal, as well as an optionally existing solder layer are structured in electrically mutually insulated partial areas in the plane extending at right angles to the beam axis in order to reduce the grid capacity. A plurality of possibilities are conceivable for suitable structures, and the mechanical properties and the ease of handling during manufacture may also be taken into account. It is essential that the grid electrodes should overlap as little as possible in the direction in parallel to the beam axis Z and that other conductor structures should have little or no overlaps with various grid electrodes. The overlaps of the electrodes in the area around the beam openings are inevitable for electrical functional reasons and they cause a minimal capacity of the grid arrangement.

The embodiment of the grid electrodes and additional elements N shown schematically in FIGS. 2(A) and (B) with a conductive layer divided into three circular ring segments between two insulating members S makes possible the use of extensively identical structures in the three grid electrode planes of the arrangement according to FIG. 1, which will thus need to differ only in the layer thickness and the width of the beam openings, wherein the connection sections of the grid electrodes in the different planes are arranged rotated by 120° in relation to one another. This leads to an easy-to-assemble, mechanically stable arrangement with very low grid capacity.

Figure 3A:
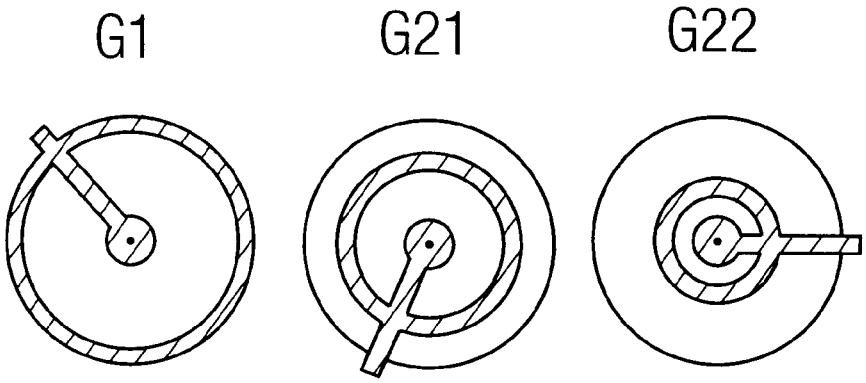
FIG. 3A is top views showing an additional example of the advantageous design and arrangement of grid electrodes.
Figure 3B:
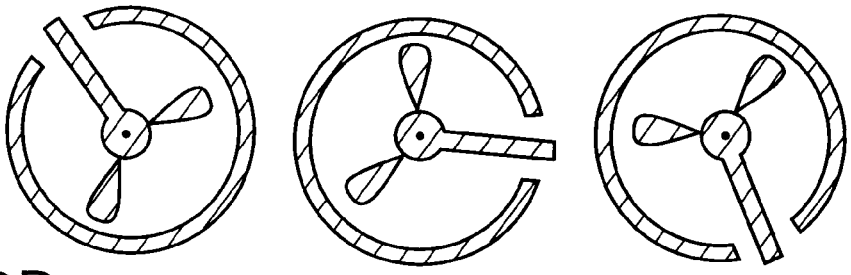
FIG. 3B is top views showing an additional example of the advantageous design and arrangement of grid electrodes.

FIG. 3 schematically shows additional examples of similar structurings in three conductor planes from a plurality of suitable structures of the conductor layers. In the embodiment according to FIG. 3A, the individual grid electrodes are designed as circular rings and narrow, radial lead webs between the terminal lug and the central part, and a reduced overlap is achieved by the circular rings having different radii and the radial lead webs being directed in an angularly offset manner. The design according to FIG. 3B again provides for narrow lead webs between the terminal lugs and central parts for the grid electrodes and additionally two holding straps each for each central part. The different grid electrodes are arranged rotated in relation to one another such that neither the lead webs nor the holding straps have overlaps. The mechanical stability can be increased by electrically insulated circular rings interrupted at the lead webs.

Figure 3C:
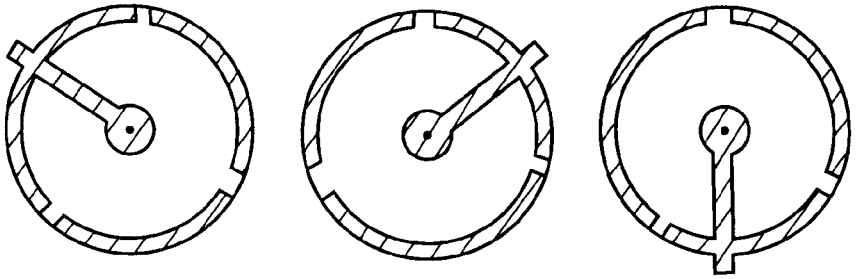
FIG. 3C is top views showing an additional example of the advantageous design and arrangement of grid electrodes.

The design according to FIG. 3C can be derived from the design according to FIG. 2 by preparing narrower circular rings instead of the segments extending over a wide radius range of about 120° each and by tapering the connection sections U into connecting webs.

Figure 4:
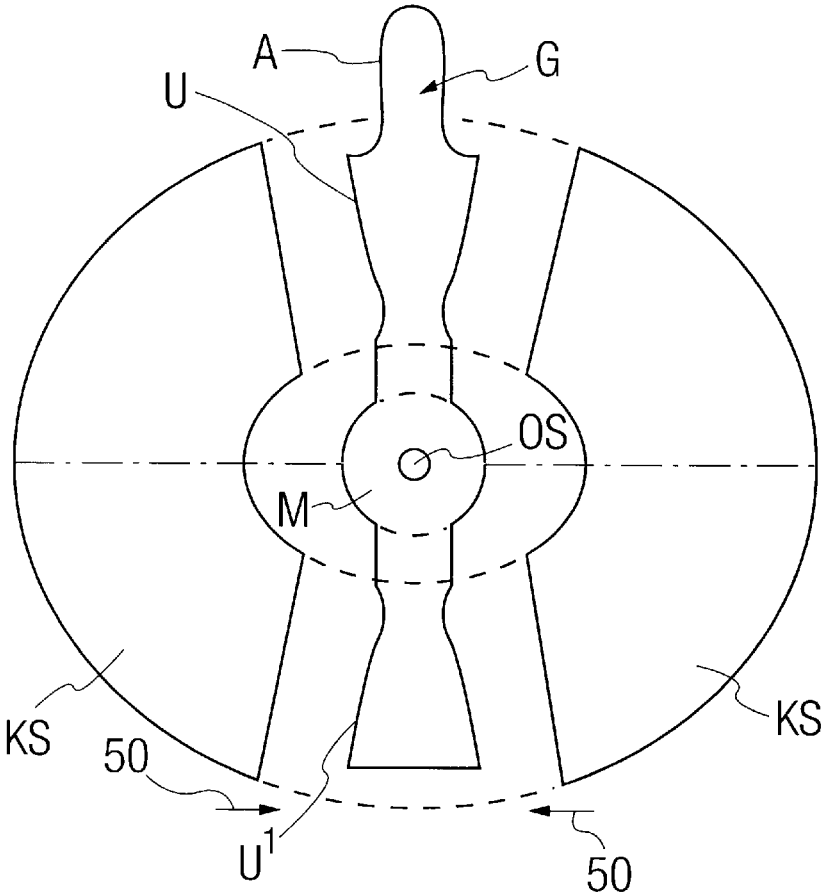
FIG. 4 is an exploded (spatially separated) view of a design according to a preferred embodiment.
Figure 4:
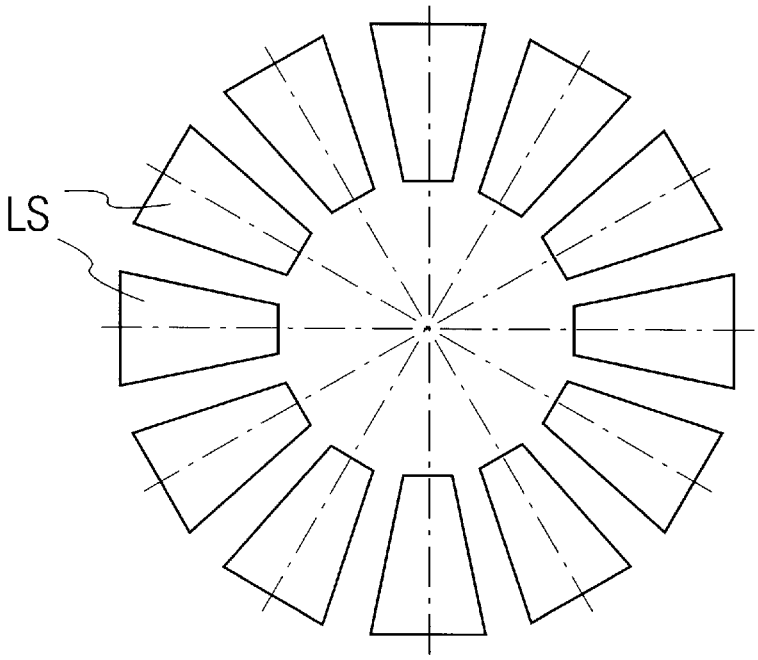

FIG. 4 shows elements of a preferred embodiment of the present invention independently, but already suggesting their relative positions in an assembled grid arrangement. A grid electrode G has a terminal lug A, a lead section U, a central part M with central beam opening OS, as well as a lead section holding element U' projecting over the central part. Insulating ceramic segments KS, which are pressed closer to the electrodes G for the assembly of the arrangement and preferably describe circles around the central beam opening OS with an inner circle radius ri and an outer circle radius ra, are schematically shown to the side of this grid electrode G.

The moving of the ceramic segments KS closer to the electrode G is indicated by arrows 50 at the lower edge of the ceramic segments KS. The ceramic segments KS and the grid electrode G have at least approximately the same thickness at right angles to the plane of the drawing. This thickness is in the range of, e.g., 150 $\mu$m.

FIG. 4 also shows schematically a ring of solder segments LS, which are arranged in a regular pattern around the beam axis. These solder segments LS are dimensioned and arranged in the radial direction from the beam axis such that their edge facing the beam axis is located at a greater distance from the beam axis than the inner circle radius of the ceramic segments KS. The edge of the solder segments LS facing away from the beam axis is located closer to the beam axis than the outer radius of the ceramic segments KS. The number of solder segments within one ring and consequently also their angular extension depend on the number of grid electrodes of the grid arrangement and is four times the number of grid electrodes in the preferred structure being described. Thus, 12 solder segments LS with a mutual angular offset of 30° and an angular extension of less than 30° per solder segment are provided in the example shown schematically with three grid electrodes G1, G21 and G22. The thickness of the solder segments at right angles to the plane of the drawing of FIG. 4 is usually substantially smaller than the thickness of the ceramic segments KS and the grid electrode E, and it typically equals 25 $\mu$m.

Furthermore, circular ring-shaped spacers made of an insulating material, preferably ceramic, are provided for the assembly of a grid arrangement according to the preferred embodiment. These are designated by S0, S1, S2 and S3 in the arrangement according to FIG. 1. To build up the layers of the preferred embodiment, such insulating spacers and electrode layers consisting of a grid electrode and two ceramic disks KS are arranged in the same manner in layers alternatingly one on top of another, inserting a solder segment layer, and the longitudinal axes of the electrode parts E in consecutive electrode layers are preferably offset by a regular angle of 120° in the example in relation to one another. The solder segment layers may contain a complete ring of solder segments. The segment positions which are located at right angles to the layer planes in extension of an electrode position rather than directly at an electrode are rather unoccupied in order to extensively avoid capacitive effects of conductive layers floating at an undefined potential.

Figure 5:
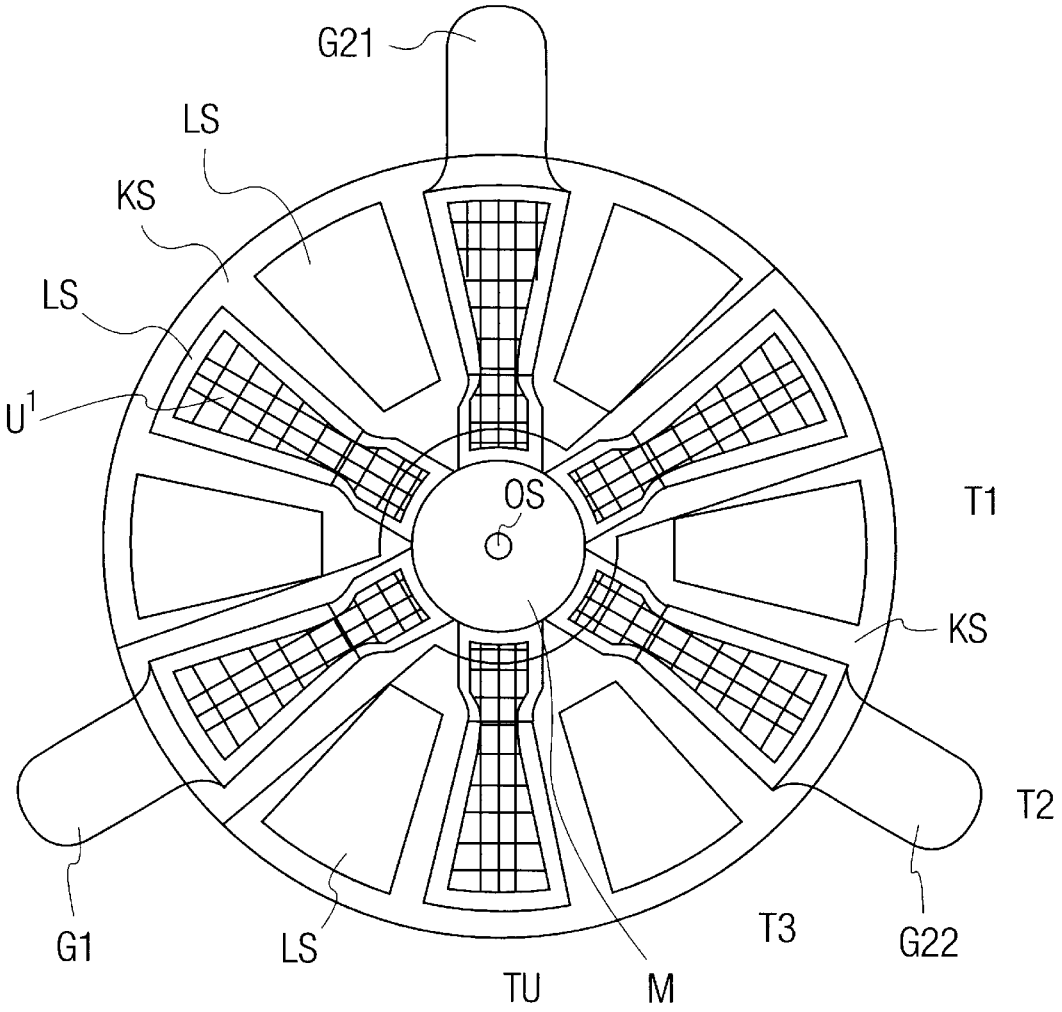
FIG. 5 is a top view of an assembled grid arrangement of the design according to FIG. 4.

FIG. 5 schematically shows an assembled grid arrangement of this type. Transparency is assumed in some areas in the direction of the beam for purposes of illustration in order to make it possible to represent actually hidden contours as well. The plurality of grid electrodes G1, G21 and G22 are arranged offset by 120° each in relation to one another and they show an overlap with their central parts M. The beam openings OS and central parts M are located concentrically around the beam axis. In contrast, the electrodes have no overlaps with one another in the lead sections U and the holding sections U', and not even indirectly via the conductive solder segments LS. The shaded areas indicate another embodiment of the grid electrodes, in which the electrodes are etched to a smaller thickness in some areas in the shaded areas, and thus they are soldered to the adjacent ceramic spacers in the edge areas of the lead and holding sections only. Mechanical stresses caused by differences in the materials of the ceramic spacers and the metallic electrodes can be reduced as a result. This leads to a symmetrical grid arrangement of extremely low capacity composed of a small number of different elements.

Figure 6:
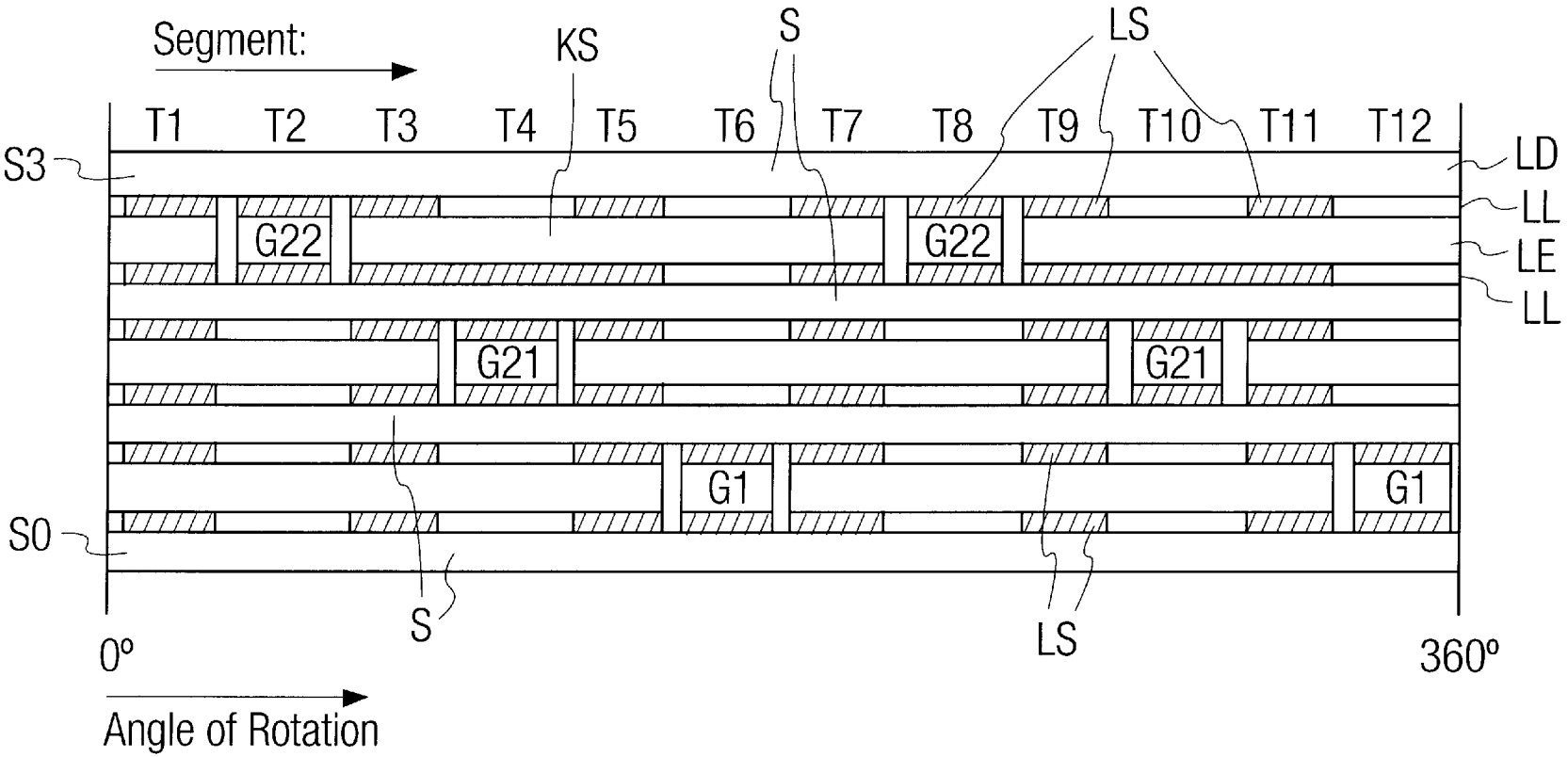
FIG. 6 is a view of a layer design over the circumferential angle.

Consecutive angular segments are designated by T1, T2, T3, . . . in the clockwise direction in FIG. 5, and the representation of FIG. 6 is based on them. FIG. 6 shows the layer structure of the arrangement according to FIG. 5 in the form of a development of the circumference with division into segments corresponding to a progression along an angle of rotation from 0° to 360°. Distinction is thus made in the representation of the layers between a layer LD consisting of a circular ring-shaped insulating spacer B, and a solder segment layer LL with solder segments LS arranged in a ring-shaped pattern, as well as an electrode layer LE with grid electrodes and insulating ceramic segments KS each. Both the spacers S and the electrode layers LE are of equal length, though not necessarily so, but the field in the area of the beam openings can be influenced, instead, by varying especially the distances between the grid electrodes. The layer structure with alternating spacers and electrode layers with solder segment layers inserted between them requires no further explanation with reference to FIG. 1 and FIG. 5.

The layer structure shows clearly that there is no conductive connection between two angular segments in any layer. A capacitive coupling between the different electrodes outside the area of the central parts is thus avoided. Furthermore, as was already mentioned as a preferred embodiment, not all angular segments are occupied by solder segments in the individual solder segment layers, but only the angular segments which either border directly on a grid electrode (T2, T8 for the electrode layer with the grid electrode G22) or contain no grid electrode in the entire structure (T1, T3, T5, T7, T9, T11).

The present invention is not limited to the examples specifically shown schematically, but a number of embodiments may be realized within the framework of the technical know-how based on the concepts of the examples given herein. In particular, the number of grid electrodes is variable. The outer contour of the connected arrangement is not necessarily circular, and spacers and grid electrodes may have different outer contours.

While specific embodiments of the invention have been shown and described in detail to illustrate the application of the principles of the invention, it will be understood that the invention may be embodied otherwise without departing from such principles.

What is claimed is:

1. A cathode ray tube with a grid arrangement comprising:

a plurality of grid electrodes following each other in a beam direction, said grid electrodes each having a central part with a central beam opening, a lead-in section and a terminal part, said central part of each of said electrodes overlapping in said beam direction, said terminal part and said lead-in section of each of said electrodes not overlapping in said beam direction, said lead-in section connecting said central part and said terminal part;

a plurality of insulating spacers with inner openings, said grid electrodes following each other in said beam direction being separated by said insulating spacers and said grid electrodes and said insulating spacers being mechanically connected, said central part and said lead-in section being disposed substantially within a periphery of said spacers and between said spacers.

2. The cathode ray tube in accordance with claim 1, wherein said insulating spacers and said grid electrodes are substantially flat.

3. The cathode ray tube in accordance with claim 1, wherein additional segments of a thickness at least approximately equal to a thickness of said lead-in section of said grid electrodes are inserted in areas not occupied by said lead-in section of said grid electrodes, between adjacent said insulating spacers.

4. The cathode ray tube in accordance with claim 3, wherein said additional segments are electrically insulated metallic segments.

5. The cathode ray tube in accordance with claim 3, wherein said additional segments consist of an insulating ceramic material.

6. The cathode ray tube in accordance with claim 1, wherein said grid electrodes are soldered to said insulating spacers.

7. The cathode ray tube in accordance with claim 3, wherein said grid electrodes and inserted additional segments are soldered to said insulating spacers.

8. The cathode ray tube in accordance with claim 1, wherein diameters of said inner openings of said insulating spacers are large compared with diameters of said central beam openings in said grid electrodes.

9. The cathode ray tube in accordance with claim 1, wherein said central part of one of said grid electrodes has approximately a dimension of one of said inner opening of one of said insulating spacers located adjacent to said one of said grid electrodes.

10. The cathode ray tube in accordance with claim 9, wherein said central part is smaller than the inner openings of the spacers and has at least one holding strap extending between the adjacent spacers.

11. The cathode ray tube in accordance with claim 9, wherein the central part extends over its entire circumference between the spacers.

12. A cathode ray tube with a grid arrangement comprising:

a plurality of grid electrodes following each other in a beam direction, said grid electrodes each having a central part with a central beam opening, said central part extending fully around said central beam opening, said central part having a radial dimension from said central beam opening to an outer periphery, a terminal part and a lead-in section extending radially from said outer periphery of said central section to said terminal part, said lead-in section not extending fully around said central part, said central part of each of said electrodes overlapping in said beam direction, said terminal part and said lead-in section of each of said electrodes not overlapping in said beam direction;

a plurality of insulating spacers with inner openings, said grid electrodes following each other in said beam direction being separated by said insulating spacers and said grid electrodes and said insulating spacers being mechanically connected, said central part and said lead in section being substantially within the radial extent of said spacers.

13. The cathode ray tube in accordance with claim 12, wherein said lead-in section is provided substantially radially inwardly of an outer radial extent of said insulating spacers and said central part has a diameter with a size similar to a diameter of said inner opening of said spacer and deviating from same by less than 30%.

14. The cathode ray tube in accordance with claim 12, wherein said insulating spacers and said grid electrodes are substantially flat.

15. The cathode ray tube in accordance with claim 12, further comprising additional segments of a thickness at least approximately equal to a thickness of said terminal part of said grid electrodes are inserted in areas wherein said lead-in section does not extend fully around said central part, between adjacent said insulating spacers.

16. The cathode ray tube in accordance with claim 15, wherein said additional segments are one of electrically insulated metallic segments and segments of an insulating material.

17. The cathode ray tube in accordance with claim 12, wherein diameters of said inner openings of said insulating spacers are large compared with diameters of said central beam openings in said grid electrodes.

18. The cathode ray tube in accordance with claim 12, wherein said central part of one of said grid electrodes has approximately a dimension of said inner opening of one of said insulating spacers located adjacent to said one of said grid electrodes.

19. The cathode ray tube in accordance with claim 9, wherein said central part is smaller than the inner openings of the spacers and has at least one holding strap extending between the adjacent spacers.

20. A cathode ray tube with a grid arrangement comprising:

a plurality of grid electrodes following each other in a beam direction, said grid electrodes each having a central part with a central beam opening, said central part having an outer periphery extending fully around said central beam opening, said central part having a radial dimension from said central beam opening to an outer periphery, a terminal part, a lead-in section extending between adjacent spacers radially from said outer periphery of said central section to said terminal part, said lead-in section not extending fully around said central part and a holding part extending between adjacent spacers radially from said outer periphery of said central section and not extending fully around said central part, said central part of each of said electrodes overlapping in said beam direction, said terminal part and said lead-in section of each of said electrodes not overlapping in said beam direction;

a plurality of insulating spacers with inner openings, said grid electrodes following each other in said beam direction being separated by said insulating spacers and said grid electrodes and said insulating spacers being mechanically connected wherein said central part of one of said grid electrodes has a diameter which is substantially the same as or smaller than a diameter of said inner opening of one of said insulating spacers located adjacent to said one of said grid electrodes.

* * * * *